US005673452A

United States Patent [19]

Chang et al.

[11] Patent Number: 5,673,452

[45] Date of Patent: Oct. 7, 1997

[54] TOOTHBRUSH

[76] Inventors: Ching-Min Chang; Ching-Lung Chang, both of 58, Ma Yuan West St., Taichung, Taiwan

[21] Appl. No.: 698,165

[22] Filed: Aug. 12, 1996

[51] Int. Cl.[6] ..... A46B 9/04

[52] U.S. Cl. ..... 15/167.1; 15/143.1; 15/144.1; 15/145; 15/172; 15/176.1; 15/176.6

[58] Field of Search ..... 15/143.1, 144.1, 15/145, 167.1, 172, 176.1, 176.6

[56] References Cited

U.S. PATENT DOCUMENTS

| | | | |
|---|---|---|---|
| 1,131,863 | 3/1915 | Phillips | 15/176.6 |
| 1,887,913 | 11/1932 | Bell | 15/167.1 X |
| 3,072,938 | 1/1963 | Phaneuf | 15/176.6 X |
| 3,181,189 | 5/1965 | Leyden | 15/145 X |
| 4,598,437 | 7/1986 | Ernest et al. | 15/176.1 |
| 4,780,924 | 11/1988 | Hansen et al. | 15/176.1 |
| 5,369,835 | 12/1994 | Clarke | 15/176.1 X |

FOREIGN PATENT DOCUMENTS

| | | | |
|---|---|---|---|
| 2550068 | 2/1985 | France | 15/167.1 |
| 2629766 | 6/1989 | France | 15/176.1 |
| 2633500 | 1/1990 | France | 15/167.1 |
| 2014278 | 10/1971 | Germany | 15/176.1 |
| 485723 | 10/1953 | Italy | 15/143.1 |
| 2081570 | 2/1982 | United Kingdom | 15/176.6 |

*Primary Examiner*—Mark Spisich

[57] ABSTRACT

A toothbrush comprises a head portion with a large number of bristles thereon, a slender rod extending rearward from the head portion, a slender tang extending rearward from the slender rod, a plurality of rings surrounding the slender rod, and a handle connected to the slender tang. A through hole is formed on an upper portion of the handle. A square hole is formed in a front interior of the handle. The square hole communicates with the through hole. An anti-slip pad is inserted in the through hole. The slender tang is inserted in the square hole.

1 Claim, 7 Drawing Sheets

TOOTHBRUSH

BACKGROUND OF THE INVENTION

The invention relates to a toothbrush. More particularly, the invention relates to an improved toothbrush which can be detached to change the head portion.

Referring to FIGS. 1 and 2, a conventional elastic toothbrush 1 has a head 17 with a large number of bristles 16 thereon, a neck 15, a connector 13 surrounded by a plurality of rings 14, and a handle 11. The upper and lower surfaces 12 of the handle 11 are non-skid surfaces. The smallest diameter of the connector 13 is almost the same as that of the neck 15. When the head 17 and the neck 15 are bent, the handle 11 will be bent also. The gums may be easily hurt while brushing the teeth. The head 17 is made of hard material, so the gums and the oral cavity may be damaged also. Since the smallest diameter of the connector 13 is almost the same as that of the neck 15 and the connector 13 is made of hard material, the flexibility of the connector 13 is limited. When the bristles 16 is broken, the whole elastic toothbrush 1 should be discarded. Referring to FIG. 3, another conventional toothbrush 2 is illustrated. The toothbrush 2 has a head with a large number of bristles 23 thereon, a neck 22, and a handle 21. A rear coupling end 24 of the neck 22 couples with a front coupling end 25 of the handle 21. The elastic fatigue of the rear coupling end 24 and the front coupling end 25 will occur after a long period of usage. Thus the rear coupling end 24 may not couple with the front coupling end 25 perfectly. Therefore, the connection between the rear coupling end 24 and the front coupling end 25 will be loosened.

SUMMARY OF THE INVENTION

An object of the invention is to provide an elastic toothbrush which can protect the gums and oral cavity from damage while brushing the teeth.

Another object of the invention is to provide an elastic toothbrush with a plurality of rings so that the elastic fatigue can be reduced and the period of time of usage can be prolonged.

According to the first preferred embodiment of the invention, a toothbrush comprises a head portion with a large number of bristles thereon, a slender rod extending rearward from the head portion, a slender tang extending rearward from the slender rod, a plurality of rings surrounding the slender rod, and a handle connected to the slender tang. A through hole is formed on an upper portion of the handle. A square hole is formed in a front interior of the handle. The square hole communicates with the through hole. A round hole and a cylinder hole are formed in the front interior of the handle. An inner groove abuts the round hole. The round hole and the cylinder hole communicate with the square hole. A hook is disposed on a rear end of the slender tang. A flange is disposed between the head portion and the slender rod. The slender rod passes through the rings. The rings are blocked by the flange. The slender tang is inserted in the square hole. anti-slip pad with two protruded lower portions are inserted in the through hole. The rear portion of the slender tang is pressed down by the anti-slip pad. A set of sharp tools can be inserted through the round hole and the cylinder hole to push the anti-slip pad upward. Therefore, the slender tang can be pulled out from the front end of the handle.

According to the second preferred embodiment of the invention, a toothbrush comprises a head portion with a large number of bristles thereon, a slender rod extending rearward from the head portion, a slender tang extending rearward from the slender rod, a plurality of rings surrounding the slender rod, and a handle connected to the slender tang. A square through hole is formed in the handle. An enlarged hole is formed on a rear end of the handle. The square through hole communicates with a round hole which is formed in a front lower portion of the handle. An inner groove abuts the round hole. A hook is disposed on a rear end of the slender tang. A flange is disposed between the head portion and the slender rod. A retaining rod has a main body, a bevel end formed on a front end of the retaining rod, a loop with a loop hole disposed on a rear end of the retaining rod, and an annular flange disposed between the main body and the loop. The slender rod passes through the rings. The rings are blocked by the flange. The slender tang is inserted in a front portion of the square through hole. An anti-slip pad is disposed on an upper front portion of the handle. The retaining rod is inserted in the square through hole via the enlarged hole. The rear portion of the slender tang is pressed down by the bevel end. The retaining rod can be pulled out from the rear end of the handle. Therefore, the slender tang can be pulled out from the front end of the handle.

According to the third preferred embodiment of the invention, a toothbrush comprises a head portion with a large number of bristles thereon, a slender rod extending rearward from the head portion, a slender tang extending rearward from the slender rod, a plurality of rings surrounding the slender rod, and a handle connected to the slender tang. An end fastener and a slot are formed on a rear end of the slender tang. An anti-slip pad is disposed on an upper front portion of the handle. A square hole is formed in a front interior of the handle. An enlarged hole is formed in the handle to communicate with the square hole. A flange is disposed between the head portion and the slender rod. The slender tang is inserted in the square hole. The end fastener is inserted in the enlarged hole.

DETAILED DESCRIPTION OF THE INVENTION

Figure 1:
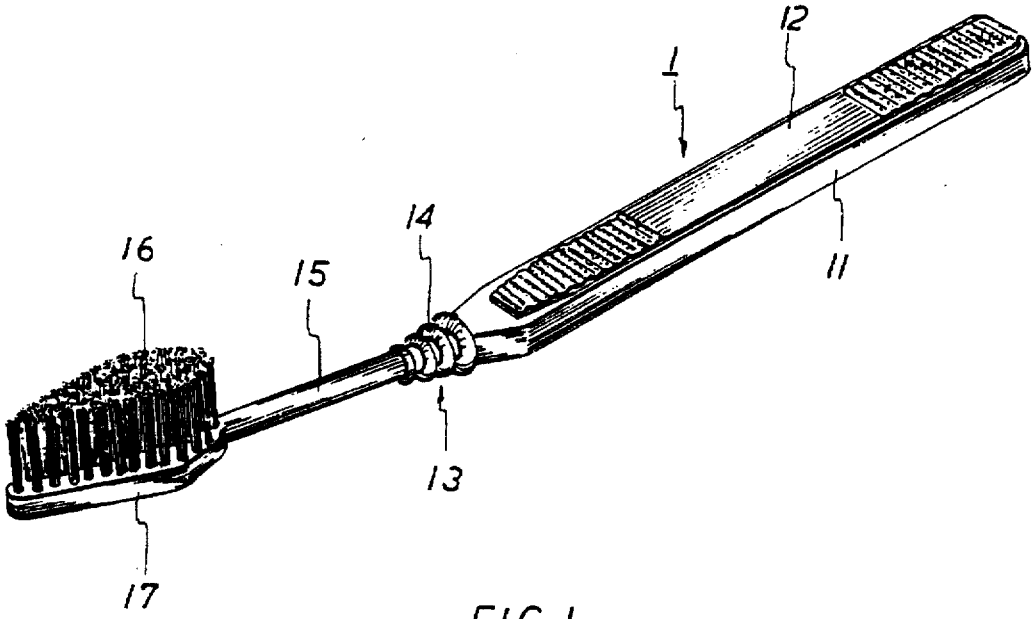
FIG.1 (PRIOR ART)
FIG. 1 is a perspective view of an elastic toothbrush of the prior art.
Figure 2:
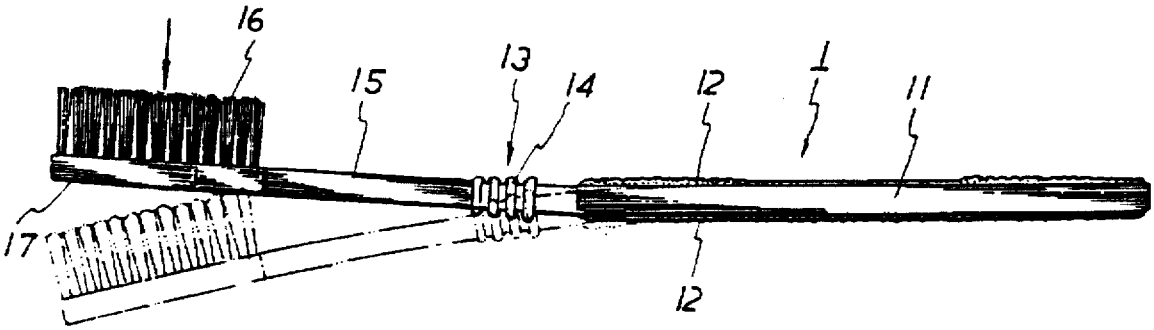
FIG.2 (PRIOR ART)
FIG. 2 is a schematic view illustrating the operation of an elastic toothbrush of the prior art.
Figure 3:
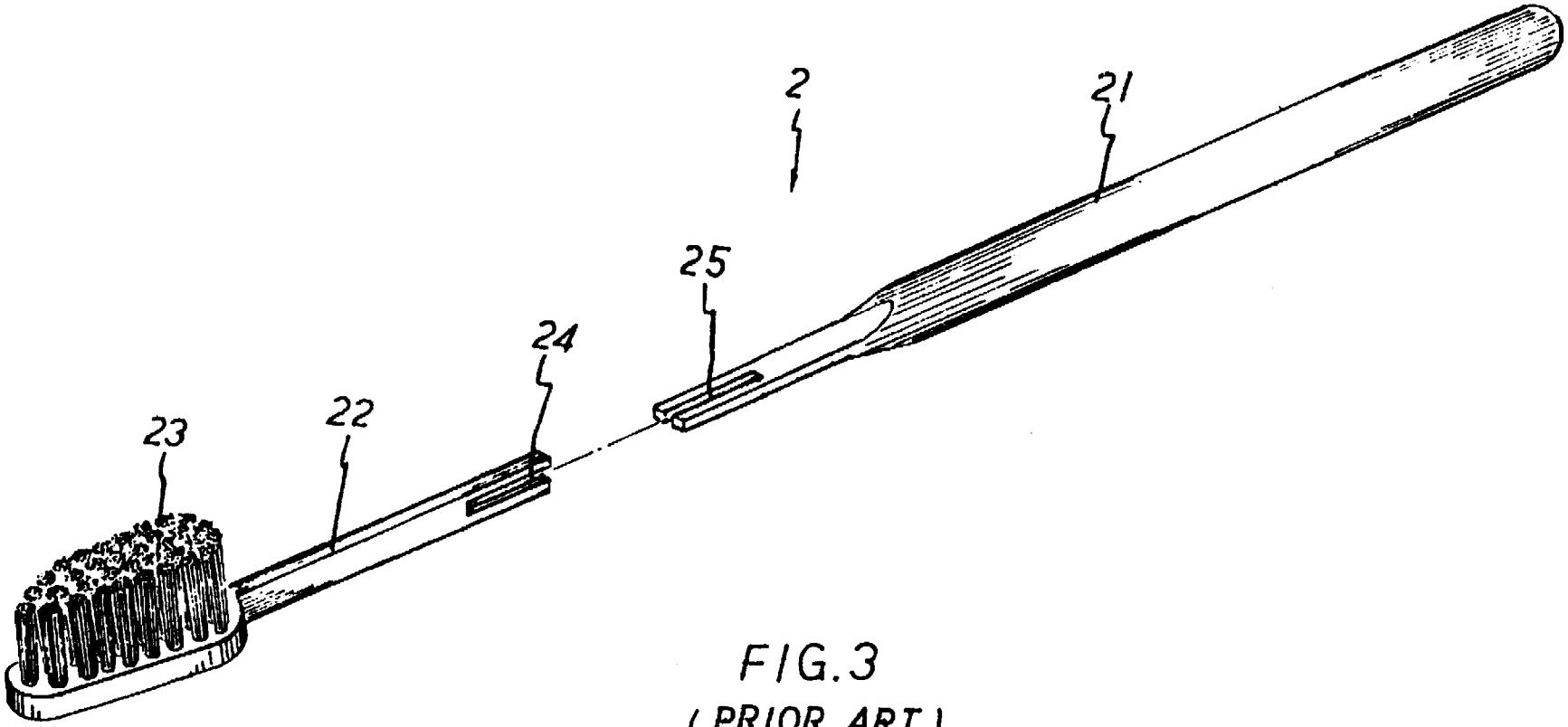
FIG. 3 (PRIOR ART)
FIG. 3 is a perspective view of another toothbrush of the prior art.
Figures 4, 5:
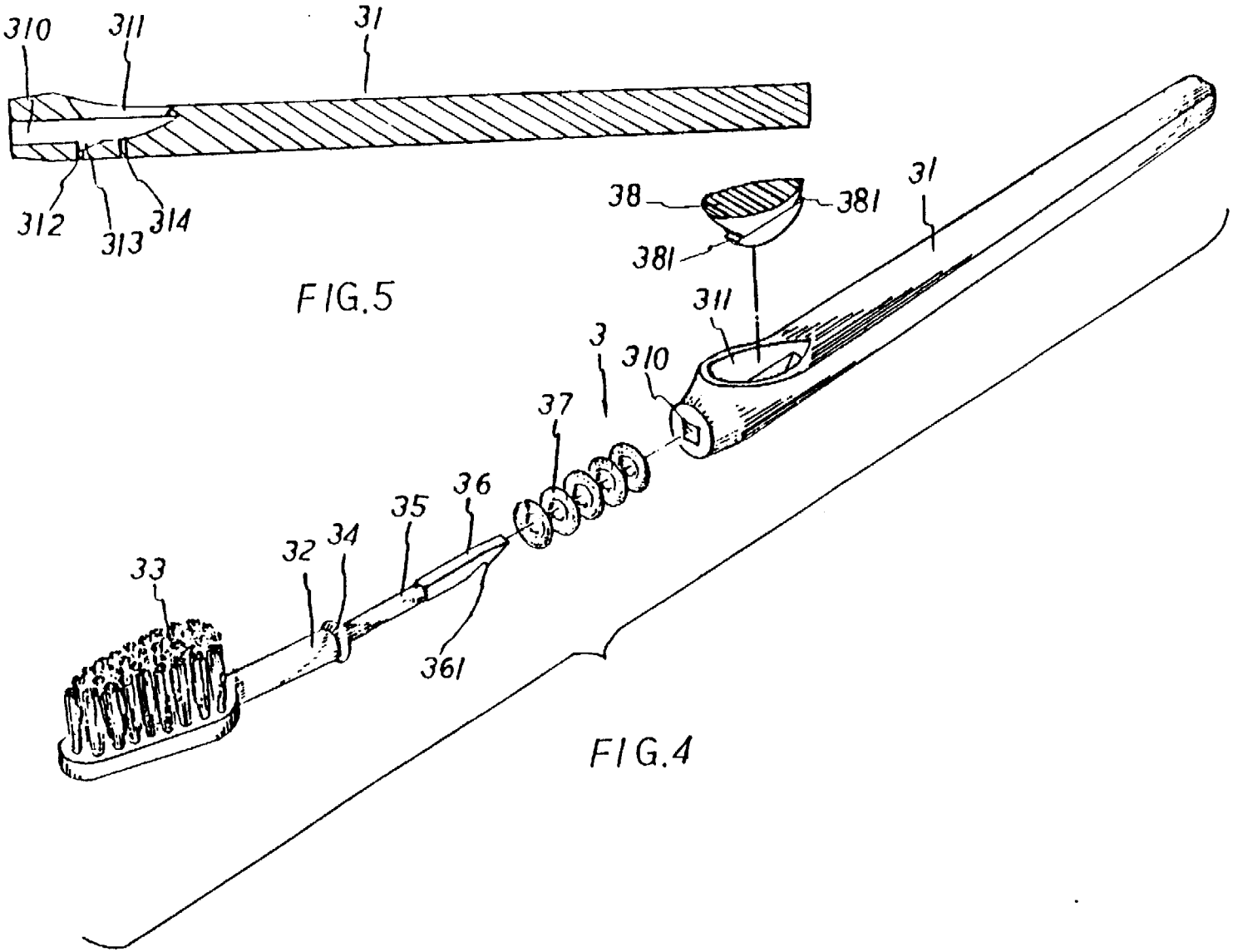
FIG. 4 is a perspective exploded view of a toothbrush of a first preferred embodiment in accordance with the invention.
FIG. 5 is a cross-sectional view of a handle of the first preferred embodiment.
Figure 8:
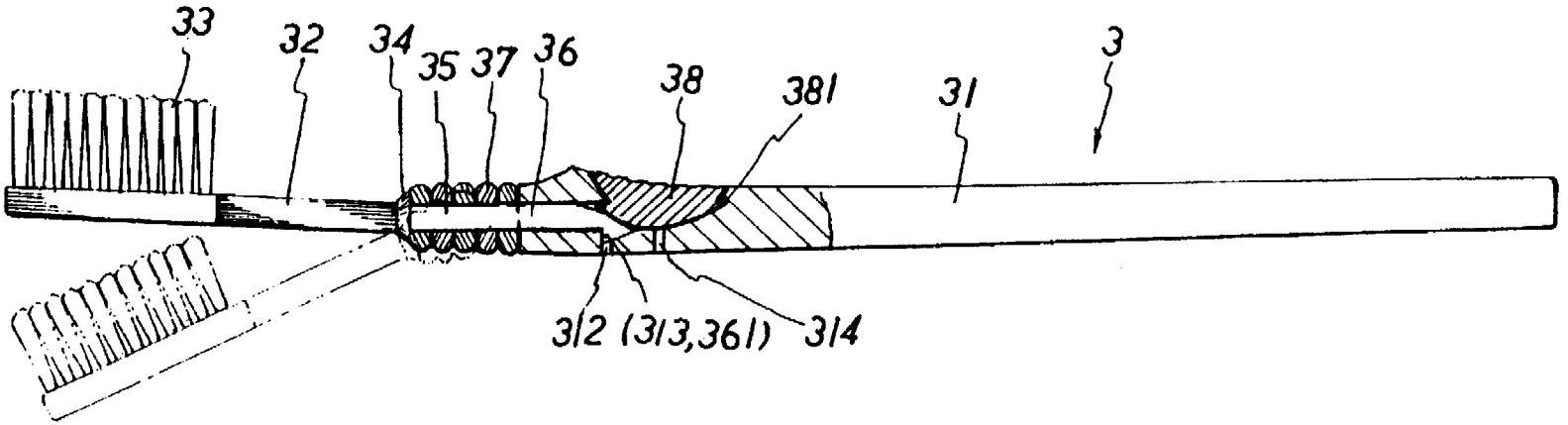
FIG. 8 is a sectional assembly view of a toothbrush of the first preferred embodiment in accordance with the invention.

Referring to FIGS. 4 and 5, a toothbrush 3 comprises a head portion 32 with a large number of bristles 33 thereon, a slender rod 35 extending rearward from the head portion 32, a slender tang 36 extending rearward from the slender rod 35, a plurality of rings 37 surrounding the slender rod 35, and a handle 31 connected to the slender tang 36. A through hole 311 is formed on an upper portion of the handle 31. A square hole 310 is formed in a front interior of the handle 31. The square hole 310 communicates with the through hole 311. A round hole 312 and a cylinder hole 314 are formed in the front interior of the handle 31. An inner groove 313 abuts the round hole 312. The round hole 312 and the cylinder hole 314 communicate with the square hole 310. A hook 361 is disposed on a rear end of the slender tang 36. A flange 34 is disposed between the head portion 32 and the slender rod 35. Referring to FIG. 8, the slender rod 35 passes through the rings 37. The rings 37 are blocked by the flange 34. The slender tang 36 is inserted in the square hole 310. An anti-slip pad 38 with two protruded lower portions 381 are inserted in the through hole 311. The rear portion of the slender tang 36 is pressed down by the anti-slip pad 38. A set of sharp tools can be inserted through the round hole 312 and the cylinder hole 314 to push the anti-slip pad 38 upward. Therefore, the slender tang 36 can be pulled out from the front end of the handle 31.

Figure 10:
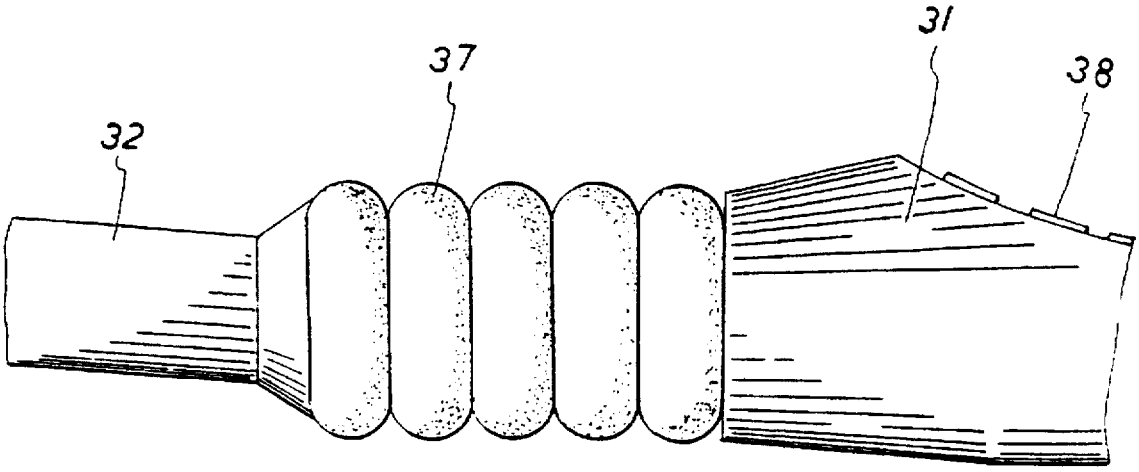
FIGS. 10 and 11 are schematic views illustrating the operation of a plurality of rings of the first preferred embodiment in accordance with the invention.
Figure 11:
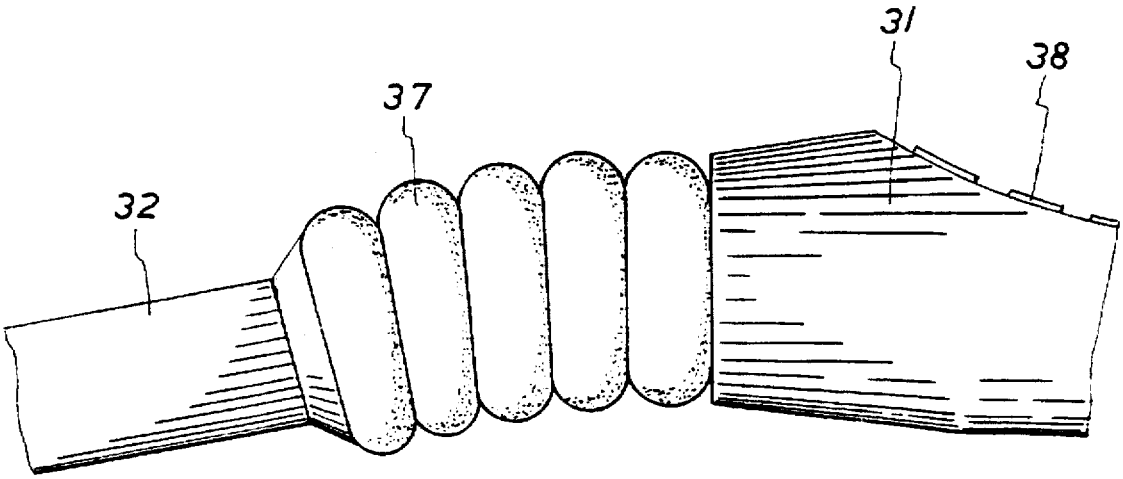

Referring to FIGS. 10 and 11, the slender rod 35 and the rings 37 are flexible. However, the handle 31 will not be bent while brushing the teeth.

Figures 6, 7:
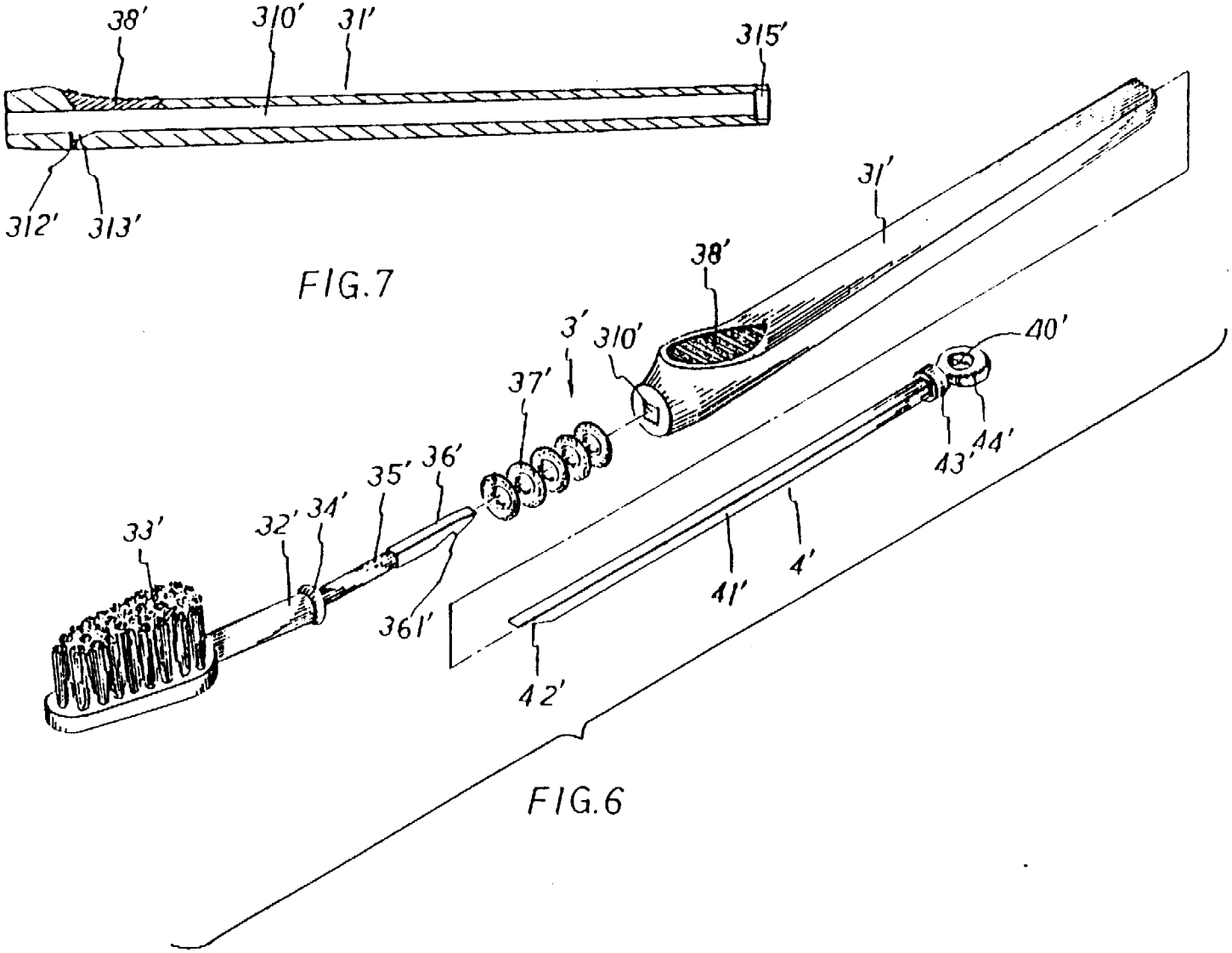
FIG. 6 is a perspective exploded view of a toothbrush of a second preferred embodiment in accordance with the invention.
FIG. 7 is a cross-sectional view of a handle of the second preferred embodiment.
Figure 9:
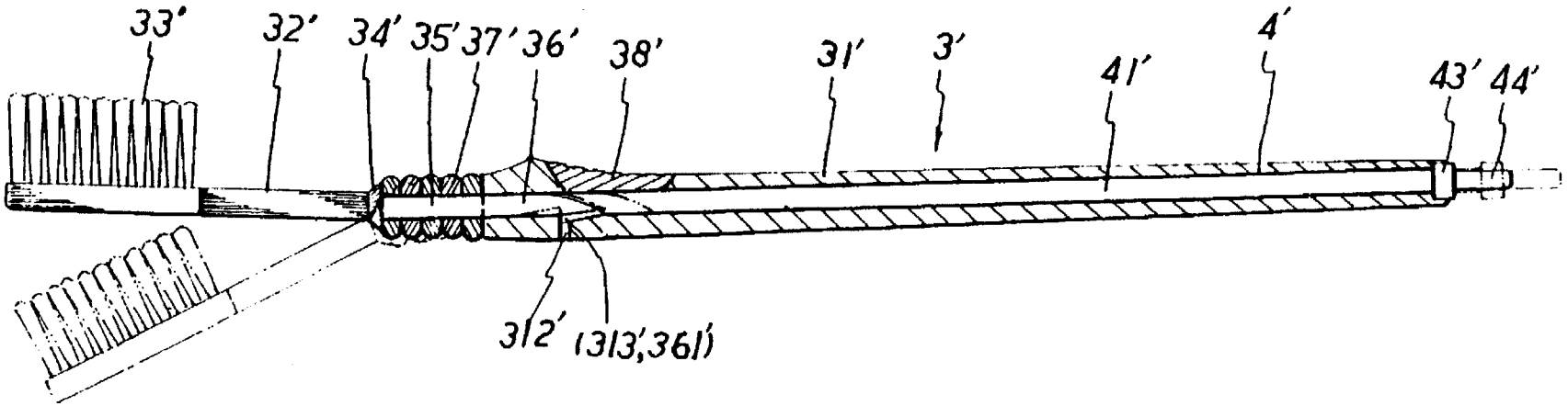
FIG. 9 is a sectional assembly view of a toothbrush of the second preferred embodiment in accordance with the invention.

Referring to FIGS. 6 and 7, a toothbrush 3' comprises a head portion 32' with a large number of bristles 33' thereon, a slender rod 35' extending rearward from the head portion 32', a slender tang 36' extending rearward from the slender rod 35', a plurality of rings 37' surrounding the slender rod 35', and a handle 31' connected to the slender tang 36'. A square through hole 310' is formed in the handle 31'. An enlarged hole 315' is formed on a rear end of the handle 31'. The square through hole 310' communicates with a round hole 312' which is formed in a front lower portion of the handle 31'. An inner groove 313' abuts the round hole 312'. A hook 361' is disposed on a rear end of the slender tang 36'. A flange 34' is disposed between the head portion 32' and the slender rod 35'. A retaining rod 4' has a main body 41', a bevel end 42' formed on a front end of the retaining rod 4', a loop 44' with a loop hole 40' disposed on a rear end of the retaining rod 4', and an annular flange 43' disposed between the main body 41' and the loop 44'. Referring to FIG. 9, the slender rod 35' passes through the rings 37'. The rings 37' are blocked by the flange 34'. The slender tang 36' is inserted in a front portion of the square through hole 310'. An anti-slip pad 38' is disposed on an upper front portion of the handle 31' The retaining rod 4' is inserted in the square through hole 310' via the enlarged hole 315'. The rear portion of the slender tang 36' is pressed down by the bevel end 42'. The retaining rod 4' can be pulled out from the rear end of the handle 31'. Therefore, the slender tang 36' can be pulled out from the front end of the handle 31'.

Figure 13:
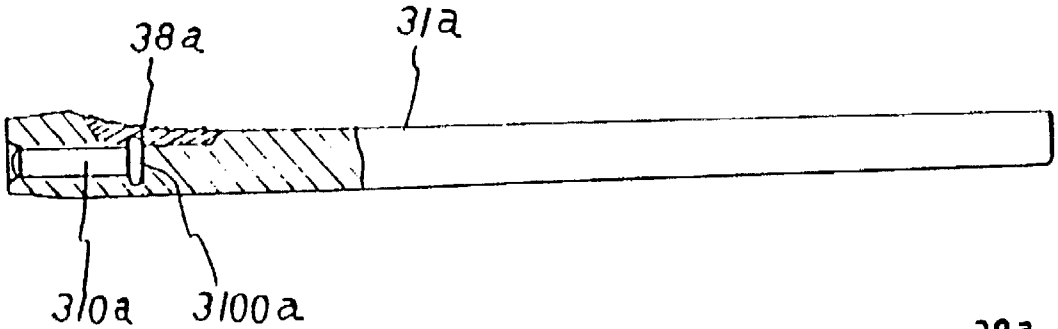
FIG. 13 is a cross-sectional view of a handle of the third preferred embodiment.
Figure 12:
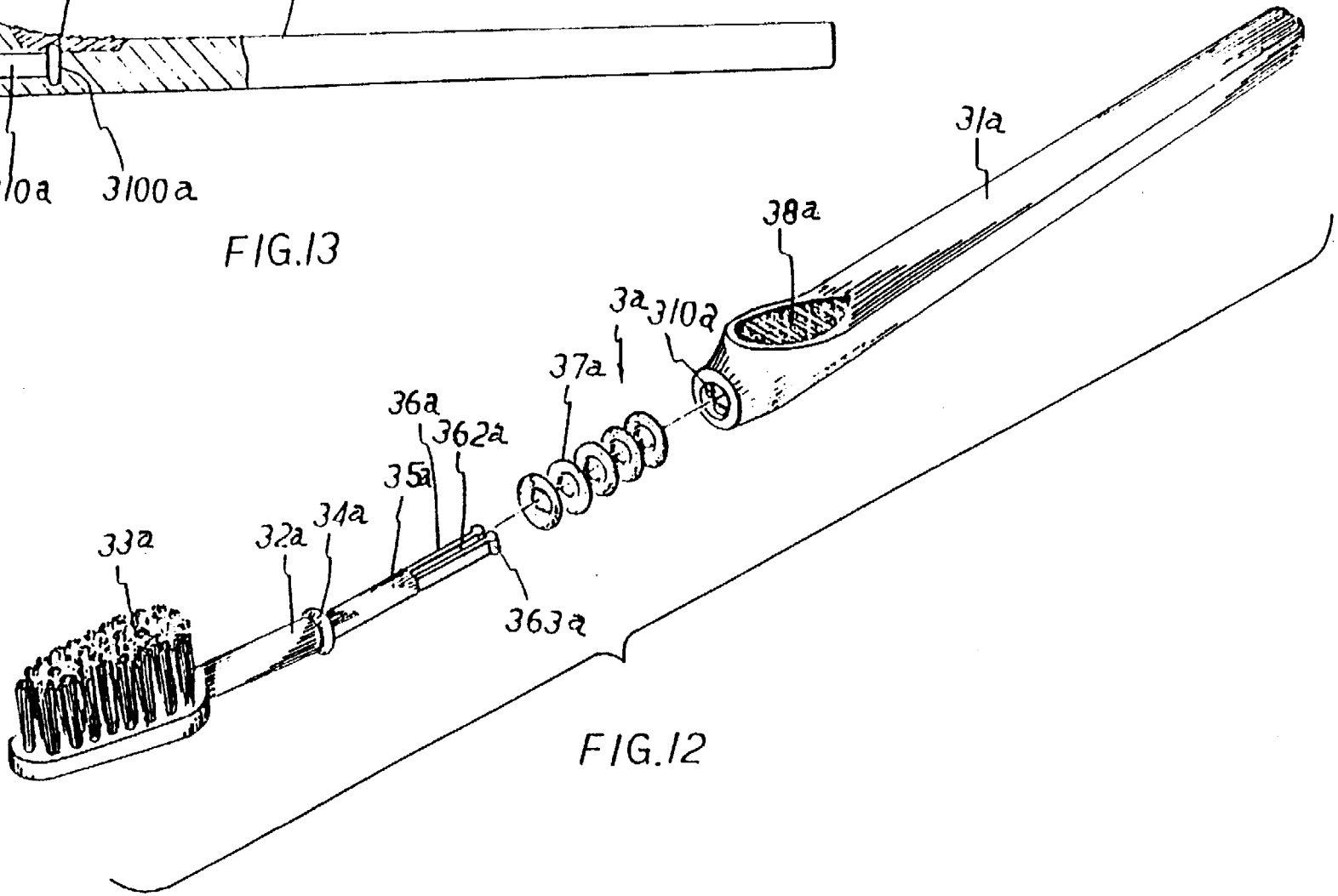
FIG. 12 is a perspective exploded view of a toothbrush of a third preferred embodiment in accordance with the invention.

Referring to FIGS. 12 and 13, a toothbrush **3*a* has a head portion 32*a* with a large number of bristles 33*a* thereon, a slender rod 35*a* extending rearward from the head portion 32*a*, a slender tang 36*a* extending rearward from the slender rod 35*a*, a plurality of rings 37*a* surrounding the slender rod 35*a*, and a handle 31*a* connected to the slender tang 36*a*. An end fastener 363*a* and a slot 362*a* are formed on a rear end of the slender tang 36*a*. An anti-slip pad 38*a* is disposed on an upper front portion of the handle 31*a*. A square hole 310*a* is formed in a front interior of the handle 31*a*. An enlarged hole 3100*a* is formed in the handle 31*a* to communicate with the square hole 310*a*. A flange 34*a* is disposed between the head portion 32*a* and the slender rod 35*a*. The slender tang 36*a* is inserted in the square hole 310*a*. The end fastener 363*a* is inserted in the enlarged hole 3100*a***.

The invention is not limited to the above embodiments but various modification thereof may be made. It will be understood by those skilled in the art that various changes in form and detail may be made without departing from the scope of the invention.

We claim:

1. A toothbrush comprising:

a head portion with a large number of bristles thereon, a slender rod extending rearward from the head portion, a slender tang extending rearward from the slender rod, a plurality of rings surrounding the slender rod, and a handle connected to the slender tang, a square hole formed in a front interior of the handle, a round hole and a cylinder hole formed in the front interior of the handle, an inner groove abutting the round hole, the round hole and the cylinder hole communicating with the square hole, a hook disposed on a rear end of the slender tang, a flange disposed between the head portion and the slender rod, the slender rod passing through the rings, the rings blocked by the flange, the slender tang inserted in the square hole, and an anti-slip pad disposed on a front upper portion of the handle.

* * * * *